United States Patent [19]

Huber et al.

[11] Patent Number: 4,651,932

[45] Date of Patent: Mar. 24, 1987

[54] ELECTROSTATIC PAINT SPRAYGUN

[75] Inventors: Willi Huber, Heerbrugg, Switzerland; Klaus Mussner, Dornbirn, Austria

[73] Assignee: J. Wagner AG, Switzerland

[21] Appl. No.: 717,812

[22] Filed: Mar. 29, 1985

[30] Foreign Application Priority Data

Apr. 2, 1984 [DE] Fed. Rep. of Germany ..... 3412266

[51] Int. Cl.[4] ..... B05B 5/02

[52] U.S. Cl. ..... 239/707

[58] Field of Search ..... 239/600, 704, 706, 707, 239/708

[56] References Cited

U.S. PATENT DOCUMENTS 4,163,520 7/1979 Garcin et al. ..... 239/707
4,266,721 5/1981 Sickles ..... 239/707 X
4,381,081 4/1983 Hastings ..... 239/707
4,440,349 4/1984 Sickles et al. ..... 239/708 X

*Primary Examiner*—Andres Kashnikow

[57] ABSTRACT

An electrostatic paint spray gun comprises a needle-shaped electrode centrally seated in the paint channel which supplies paint to a spray nozzle and projects slightly beyond the spray nozzle. The electrode is composed of two needle electrodes disposed coaxially behind one another and electrically connected in series. The rear needle electrode is secured to the pistol tube and the forward needle is secured to a closure containing the spray nozzle and emplaced on the pistol tube of the spray gun. When the closure is in place, the rear electrode needle represents the electrical connection to the forward electrode needle, whereas, when the closure is removed, the tip of the rear electrode needle projects freely beyond the mouth of the pistol tube.

4 Claims, 2 Drawing Figures

ELECTROSTATIC PAINT SPRAYGUN

BACKGROUND OF THE INVENTION

1. Field of the Invention

The present invention relates to an electrostatic paint spraygun which comprises a needle-shaped electrode centrally seated in a paint channel for delivering paint to a spray nozzle and projecting slightly beyond the spray nozzle, the electrode being connected to a high-voltage feed which extends through a tube of the spraygun, and in which a closure element containing the spray nozzle is releasably received on the mouth of the tube.

2. Description of the Prior Art

Numerous embodiments of electrostatic paint sprayguns of the type generally set forth above have been on the market for a long time. All of these known sprayguns, however, share a common problem that always occurs when the front closure is removed from the pistol tube of the spraygun, for example when the paint channel is blocked or when the paint channel is to be rinsed when changing paints. When the needle electrode, which has a slight projection of, for example, 5 mm relative to the spray nozzle or, respectively the front face of the gun when the closure is in place is seated in the pistol tube and the closure is then removed, then a rather considerable projection relative to the end face of the pistol tube occurs for the electrode needle remaining at the pistol tube and this projection can lead to bending, damage or even breakage, particularly given extremely thin electrode needles. In addition, there is a hazard of the possibility of injury to an operator. When, however, the electrode needle is seated at the closure, i.e. when it is removed from the pistol tube together with the closure when the closure is removed, then the pistol tube no longer has a defined electrode or, respectively, no defined end point of the component parts carrying high voltage. When, during the rinsing operation, the high voltage is intentionally left switched on or is unintentionally switched on, or when the conductive components in the forward region of the piston tube have a capacitance which is not inconsiderable, then uncontrolled electrical events can arise, particularly undesired sparking, which involve hazards both for the operator and with respect to igniting rinsing agent vapors.

SUMMARY OF THE INVENTION

It is therefore the object of the present invention to provide an improved electrostatic spraygun of the type generally set forth above, which spraygun is also completely safe given a removed closure, in particular from an electrical standpoint and from a mechanical standpoint.

According to the invention, the above object is achieved in a spraygun of the type generally set forth above in that the electrode is composed of two needles disposed coaxially one behind the other, where the forward needle is secured to the closure and the rear needle is seated in the pistol tube and is electrically conductively connected to the high-voltage feed, whereby when the closure is in place, the tip of the rear electrode needle is electrically conductively connected to the forward electrode needle and whereby, when the closure is removed, the tip of the rear electrode needle projects freely beyond the mouth of the pistol tube of the spraygun.

According to the invention, therefore, two series-connected electrode needles are provided, whereby the forward electrode needle is secured to the closure and the rear electrode needle is secured in the pistol tube. During spray operation, i.e. when the closure is in place, the forward needle represents the traditional spray electrode, whereby the rear needle serves only as an electrical line connection between the high-voltage feed and the forward electrode needle. When, however, the closure and, therefore, the forward electrode needle are removed, then the rear electrode needle which now projects freely beyond the mouth of the remaining pistol tube represents an accurately-defined termination of the high-voltage line, namely a slightly projecting needle electrode. Undefined and uncontrollable discharges can therefore not occur due to capacitive residual energies with a disconnected high voltage and cannot occur given connected high voltage. There is also no injury hazard for the operator and no risk of damage to the rear electrode needle because the projection thereof is slight, comparable to that of the forward electrode needle when the closure is in place. A further advantage of the division of the high-voltage electrodes into two needle electrodes is that a relatively thick and blunt and, therefore, rugged and inexpensive needle can be employed for the rear electrode, in contrast whereto a thin electrode with a high charging effect which is of high quality with respect to material and surface quality is preferred for the forward needle. This is of particular significance for atomizer nozzles having a relatively small throughput aperture (high-pressure paint guns) and for slotted needles. Finally, if desirable, the rear electrode needle can be utilized for pre-charging of the spray material.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
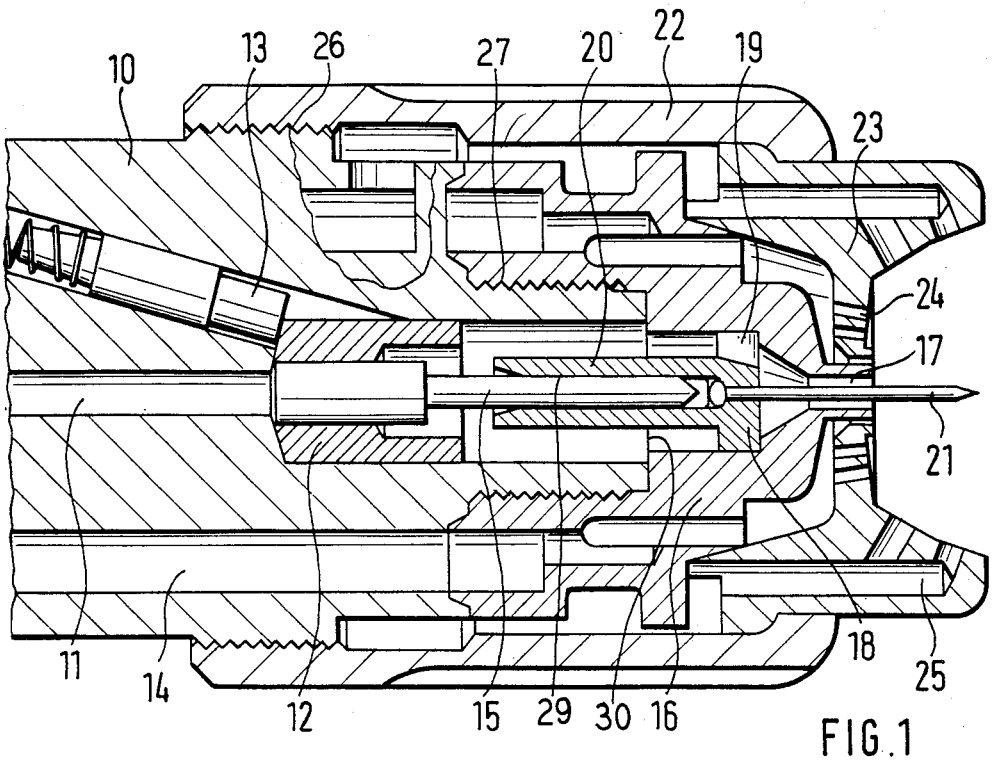
FIG. 1 is a longitudinal sectional view taken through the forward portion of the pistol tube of an electrostatic spraygun constructed in accordance with a first embodiment of the invention.

A spraygun whose front barrel end is illustrated in section in FIG. 1 is an electrostatic spraygun having compressed air atomization and additional air jets for shaping the paint cloud. The spray gun comprises a pistol tube 10 in which a paint delivery line 11 as a first paint passageway extends centrally, the paint delivery line 11 being terminated by a paint valve 12. A high-voltage line 13 also ends at the valve 12. Further, the pistol tube 10 also includes an air feed line 14. A first electrode needle 15 is secured at that surface of the paint valve 12 which faces in the direction towards the forward end of the gun.

A cap-like nozzle member 16 centrally contains an atomizer nozzle 17 and a plate 18 including an opening 19 which together with a nozzle 17 forms a second paint passage 19, the plate 18 being pressed into the nozzle member 16 behind the atomizer nozzle and continuing rearwardly as a receptacle sleeve 20 including a bore 29 for the electrode needle 15. Further, a second electrode needle 21 is soldered into the plate 18, the second electrode needle 21 extending through the atomizer nozzle 17 and projecting beyond the forward opening thereof to a predetermined, slight distance.

Finally, a closure member 23 is in place on the pistol tube by way of a screw cap 22, the atomizer nozzle being seated in the central main rearwardly facing chamber of the closure member 23. Air exit channels 24 for the atomization air are provided in the closure member 23 concentric to its central opening and, therefore, to the atomizer nozzle 17. Further, the closure member 23 is also provided with so-called air horns, i.e. salient elements which comprise bores 25 for control air.

In general, the pistol tube 10, the closure member 23 and the screw cap 22 are formed of electrically-insulating plastic material. The paint valve 12, the nozzle member 16 with the plate 18 and the sleeve 20, as well as the two electrode needles 15 and 21, are formed of electrically-conductive material, particularly metal.

In order to initiate the spray operation, the trigger (not shown) of the gun is actuated, whereupon the paint valve 12 opens its paint passage. The paint then flows past the sleeve 20 and through the opening 19 to the nozzle 17 and is sprayed out as a forward discharge. Together with the opening of the paint feed, or immediately before such opening, the air feed is also opened, so that the atomizer air emerges from the bores 24 and control air emerges from the bores 25. The electrostatic field between the gun and the workpiece to be sprayed thereby emanates from the tip of the forward electrode needle 21, whereby the latter has an electrically-conductive connection to the high-voltage feed 13 via the plate 18, the sleeve 20, the rear electrode needle 15 and the paint valve 12. With respect to the spray operation, the described spray gun does not differ from known electrostatic paint sprayguns having compressed air atomization, control air and a central electrode needle.

When, however, a rinsing operation is to be undertaken, for example, the screw cap 22 is first screwed off from the thread 26 and removed together with the closure member 23. Thereupon, the nozzle member 16 is screwed off from the thread 27 of the pistol tube 10 and removed together with the elements integrated therewith, namely the plate 18, the sleeve 20 and the forward needle electrode 21. As the rear electrode needle 15 normally projects beyond the forward face of the piston tube 10, with the aforementioned elements removed, the rear electrode needle 15 now projects freely beyond the forward face 30 of the pistol tube 10, namely preferably to a distance which corresponds to that distance by which the forward electrode needle 21 projects beyond the forward end of the nozzle 17 when the spraygun is assembled. Therewith, however, the same conditions exist electrically during the following rinsing operation as exist during the actual spray operation, i.e. a defined point of departure for the electrostatic field is now also provided. There are therefore also no hazards for the operator during the rinsing operation, in particular neither with engaged high voltage nor with disengaged high voltage (capacitance arcs). Over and above this, the danger of igniting rinse agent vapors due to uncontrollable sparking is also avoided. Also of significance is that the needle electrode 15, as mentioned, projects only slightly beyond the pistol tube, this substantially reducing the risks of a mechanical injury to the operator or of damage to the needle. It is advantageous when the electrode needle 21, building up the electrostatic field for the actual spray operation, is fashioned very thin and is very precisely fabricated with respect to its surface and the conicity of its tip. In other words, the electrode needle 21 should be composed of high-quality material, should have an accurate needle shape and should be highly burnished. In comparison thereto, only low requirements need be made of the rear electrode needle 15 because it serves as an electrode only during the rinsing operation, but only represents a contact pin otherwise. As illustrated on the drawing, the rear needle 15 can therefore be considerably thicker, this increasing its resistability.

Figure 2:
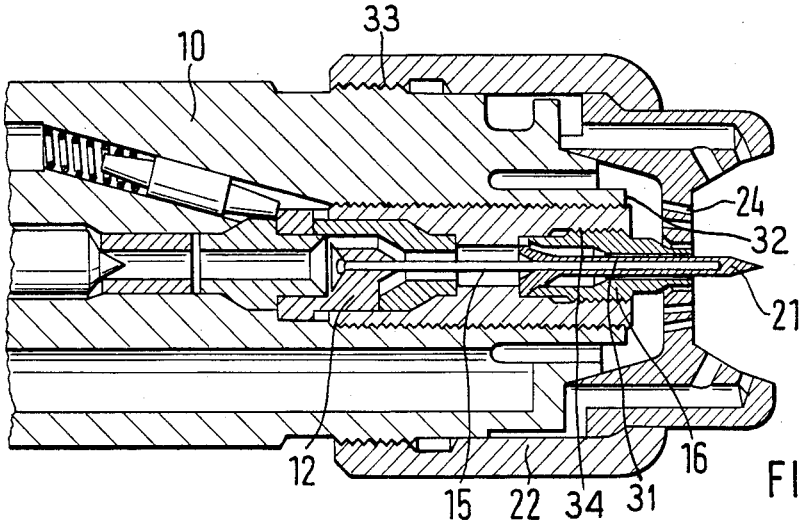
FIG. 2 is a longitudinal section, similar to that of FIG. 1, taken through the forward portion of the piston tube of an electrostatic spraygun and constructed in accordance with a second embodiment of the invention.

Referring to FIG. 2, the embodiment illustrated therein differs from the embodiment of FIG. 1 only with respect to the shape of the nozzle member 16 and to the contacting of the two needle electrodes 15 and 21. The nozzle member 16 is thereby a simple screw member having a sleeve-like continuation extending rearwardly to which the forward needle electrode 21 is secured. The needle electrode 21 comprises an inner bore 31 into which the rear electrode 15 engages when the gun is screwed together. In this case, therefore, there is a direct electrical contact between the two electrodes 15, 21. As in the exemplary embodiment described above, after the screw cap 22, closure member 23 and nozzle member 16 have been unscrewed and removed from the respective threaded portions 33, 34, the remaining rear electrode 15 projects beyond the forward face 32 of the pistol tube 10 and therefore forms a defined electrode during the rinsing operation. Of course, the present invention is applicable not only to compressed air atomizer spray guns, but is also applicable to paint air guns operating with and without additional compressed air, whereby the plate 18 set forth in the first embodiment can be designed as a spin plate. Furthermore, one practicing the present invention may resort to numerous modifications, particularly with respect to the mounting and the contacting of the two electrode needles. Therefore, for example, it is also possible to fashion the closure member which comprises two respective members in the above example, namely the closure member 23 and the nozzle member 16, of one piece, so that the entire closure can be removed at once after the screw cap 22 has been unscrewed. Finally, it should also be pointed out that the illustrated advantages of the invention apply not only during the rinsing operation, but are always true whenever the forward closure is removed, for example for the purpose of replacing the nozzle member.

Although we have described our invention by reference to particular illustrative embodiments and modification thereof, many other changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. In an electrostatic spraygun of the type in which a needle-shaped electrode is mounted axially in the pistol tube of the spraygun and extends from the spray nozzle of the spraygun by a predetermined distance, in which the needle-shaped electrode is connected to a high-voltage feed, and in which a closure is releasably secured to the forward end of the pistol tube and secures the spray nozzle thereto, the improvement wherein:

the needle-shaped electrode comprises two needle releasably mechanically and electrically coupled in series during spraying, including a forward needle secured to the closure and extending beyond the spray nozzle the predetermined distance when the closure is secured to the pistol tube, and a rear needle which is connected to the high-voltage feed.

2. The improved electrostatic spraygun of claim 1, wherein said rear needle is mounted to extend said predetermined distance beyond the forward end of the pistol tube when the closure and said forward needle are removed.

3. The improved electrostatic spraygun of claim 1, wherein:

said forward needle has a first predetermined diameter; and said rear needle has a second predetermined diameter which is larger than said first predetermined diameter of said forward needle.

4. The improved electrostatic paint spraygun of claim 1, wherein:

said forward needle comprises a bore for releasably embracing and establishing electrical contact with the tip of said rear needle.

* * * * *